US007068963B2

(12) United States Patent
Moore et al.

(10) Patent No.: US 7,068,963 B2
(45) Date of Patent: Jun. 27, 2006

(54) SYSTEMS AND METHODS FOR TONER CARTRIDGE CONVERSION

(75) Inventors: Darin L. Moore, Morrisville, NC (US); Matthew P. Daniels, Pittsboro, NC (US)

(73) Assignee: Static Control Components, Inc., Sanford, NC (US)

( * ) Notice: Subject to any disclaimer, the term of this patent is extended or adjusted under 35 U.S.C. 154(b) by 125 days.

(21) Appl. No.: 10/797,968

(22) Filed: Mar. 11, 2004

(65) Prior Publication Data

US 2004/0170445 A1 Sep. 2, 2004

Related U.S. Application Data

(63) Continuation-in-part of application No. 10/319,088, filed on Dec. 14, 2002, now Pat. No. 6,904,248.

(51) Int. Cl.
*G03G 15/00* (2006.01)

(52) U.S. Cl. ..... 399/109

(58) Field of Classification Search ..... None
See application file for complete search history.

(56) References Cited

U.S. PATENT DOCUMENTS 5,261,326 A 11/1993 Michlin
5,729,795 A * 3/1998 Kavolius et al. ..... 399/109
5,870,654 A * 2/1999 Sato et al. ..... 399/109
6,615,008 B1 * 9/2003 Higeta et al. ..... 399/109
6,721,520 B1 * 4/2004 Higeta et al. ..... 399/109
6,788,908 B1 * 9/2004 Sekine ..... 399/109
6,941,092 B1 * 9/2005 Yokoi ..... 399/109
2002/0034398 A1 * 3/2002 Higeta et al. ..... 399/109
2002/0106213 A1 * 8/2002 Higeta et al. ..... 399/104
2002/0172528 A1 * 11/2002 Sekine ..... 399/109
2004/0091282 A1 * 5/2004 Yokoi ..... 399/109
2004/0114959 A1 * 6/2004 Daniels ..... 399/109
2004/0170445 A1 * 9/2004 Moore et al. ..... 399/109
2005/0135836 A1 * 6/2005 Rogers et al. ..... 399/109

* cited by examiner

*Primary Examiner*—Diego Gutierrez
*Assistant Examiner*—Tiffany A. Fetzner

(57) ABSTRACT

Techniques for modifying a toner cartridge intended to operate with a first type of imaging device to operate in a second type of imaging device. The toner cartridge includes a drum shutter connected to a waste bin, with the drum shutter including first and second shutter arms. A method of modifying the toner cartridge intended for operation in the first type of imaging device to operate in a second type of imaging device includes removing a portion of the first shutter arm. In another aspect, the method includes removing a portion of the waste bin adjacent to the first shutter arm. In another aspect, the method includes removing a second portion of the waste bin to form a hole in the waste bin and attaching a chip mounting patch to the waste bin to fill the hole. A computer chip may be attached to the chip mounting patch.

9 Claims, 5 Drawing Sheets

SYSTEMS AND METHODS FOR TONER CARTRIDGE CONVERSION

The present application is a continuation-in-part (CIP) of U.S. patent application Ser. No. 10/319,088 entitled "Method and Apparatus For Converting Toner Cartridges to Fit Various Types of Printing Machines" filed on Dec. 14, 2002 now U.S. Pat. No. 6,904,248 and incorporated by reference herein in its entirety.

BACKGROUND

The present invention relates to remanufacturing and modifying electrophotographic toner cartridges, and more particularly to techniques for modifying an electrophotographic toner cartridge intended to operate in one type of imaging device to operate in another type of imaging device.

In the imaging industry, there is a growing market for the remanufacture and refurbishing of various types of imaging components such as toner cartridges, ink cartridges, magnetic rollers, seals, and the like. Toner cartridges, once spent, are unusable for their originally intended purpose. Without a refurbishing process, they would simply be discarded, even though the cartridge itself may still have potential life. As a result, techniques have been developed specifically to address this issue. These processes may entail, for example, the disassembly of the various structures of the cartridge, replacing toner, cleaning, adjusting or replacing any worn components and reassembling the cartridge.

The differences between printer cartridges for various types of printing devices may only be slight or subtle. In many instances it may only be an indentation or protuberance in the body of the cartridge. In other cases it may be not only a physical attribute of the body of the cartridge, but also the addition of a communications device. Certain style cartridges may be plentiful and relatively inexpensive simply because of certain factors such as the supply in the market or initial cost while other style cartridges may not be available in quantity or too expensive for cost effective use in remanufacturing. The easiest and most economic solution would be to simply convert the inexpensive style cartridges into the more costly style cartridge in order to meet this market demand.

SUMMARY

In accordance with an embodiment of the present invention, techniques are provided for modifying a toner cartridge intended to operate in one type of imaging device to operate in another type of imaging device.

In one aspect of the present invention, a toner cartridge intended to operate with a first type of imaging device includes a drum shutter connected to a waste bin, with the drum shutter including first and second shutter arms. A method of modifying the toner cartridge intended for operation in the first type of imaging device to operate in a second type of imaging device includes removing a portion of the first shutter arm.

In another aspect of the present invention, the method includes removing a portion of the waste bin adjacent to the first shutter arm.

In another aspect of the present invention, the method includes removing a second portion of the waste bin to form a hole in the waste bin and attaching a chip mounting patch to the waste bin to fill the hole. A computer chip may be attached to the chip mounting patch.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific techniques for converting an HP1200 toner printer cartridge for use in an HP1300 printer are disclosed. Other embodiments having different structures and operations for the conversion of other types of cartridges for use with other types of imaging devices and printers do not depart from the scope of the present invention.

Figure 1:
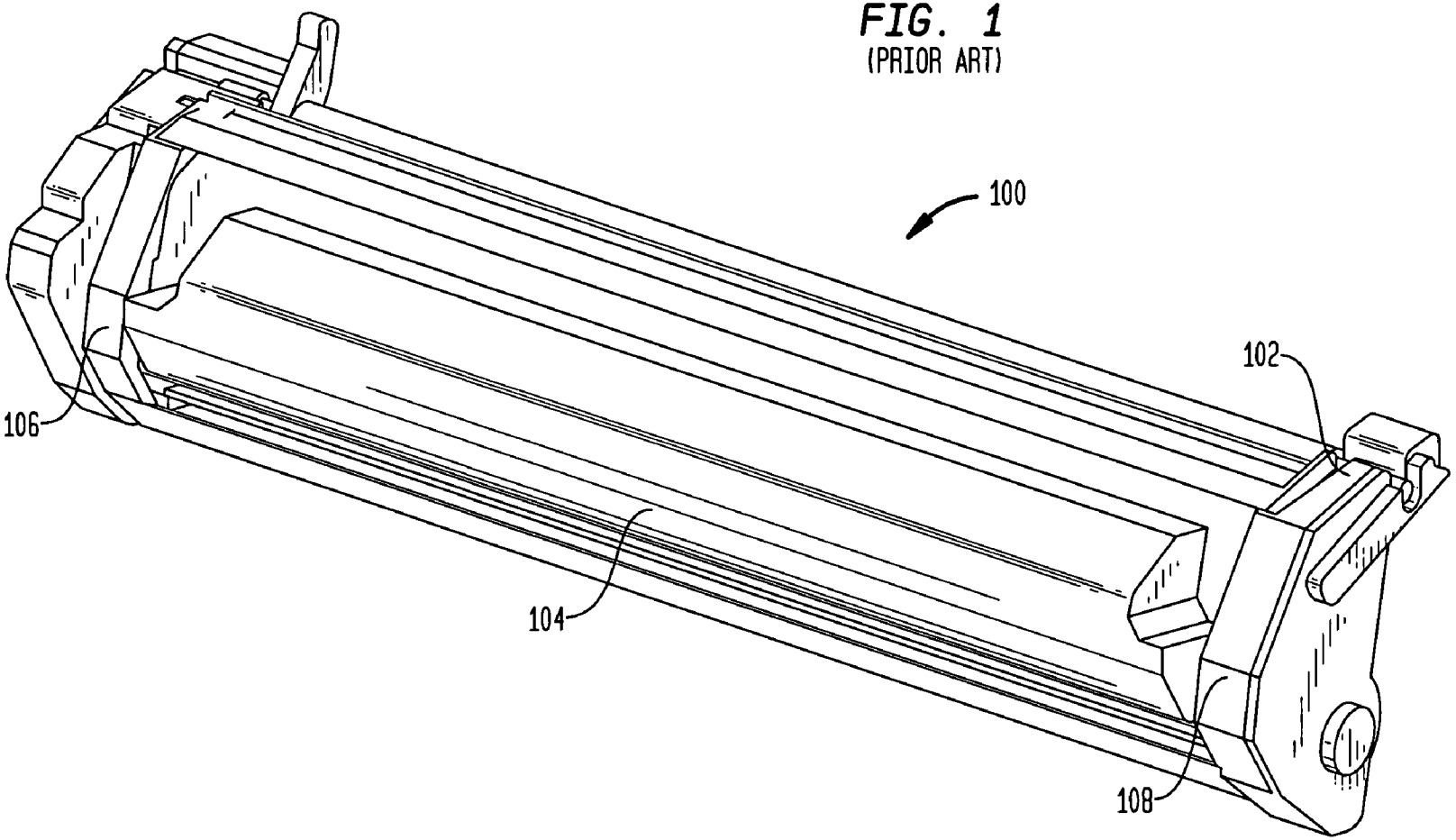
FIG. 1 (PRIOR ART)
FIG. 1 shows a perspective view of a prior art toner waste bin assembly.
Figure 2:
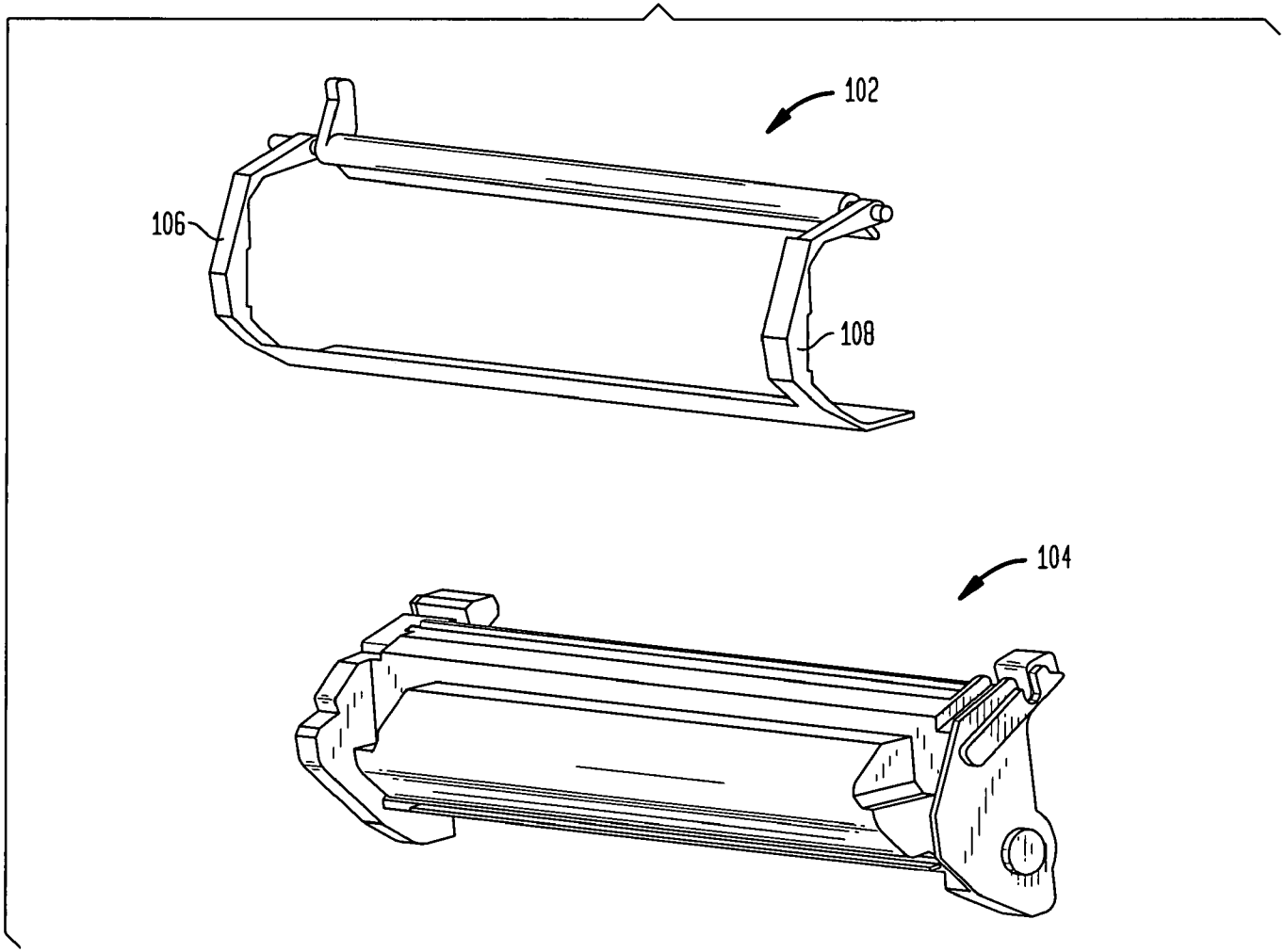
FIG. 2 (PRIOR ART)
FIG. 2 shows an exploded perspective view of a prior art toner waste bin assembly.

FIG. 1 shows a perspective view of waste bin assembly 100 a prior art toner cartridge, specifically an HP1200 toner cartridge. The waste bin assembly 100 includes a drum shutter 102 rotatably attached to a waste bin 104. The drum shutter includes arms 106 and 108. The drum shutter 102 protects an optical photoconductor (OPC) drum from being exposed to light or contacted by a user when the toner cartridge is not installed in an imaging device. Interaction between the drum shutter 102 and mating features in the imaging device causes the drum shutter to be retracted as the cartridge is installed in the imaging device, thus exposing the OPC drum. FIG. 2 shows an exploded view of the waste bin assembly 100 to better illustrate the drum shutter 102 and the waste bin 104.

Other laser printers, such as the HP1300 laser printer, utilize a toner cartridge with many similarities, but also with a few important differences which prevent an unmodified HP1200 toner cartridge from operating in an HP1300 printer. In order to convert an HP1200 toner cartridge to an HP1300 compatible toner cartridge, certain modifications need to be made to the HP1200 toner cartridge to account for these differences.

Figure 3:
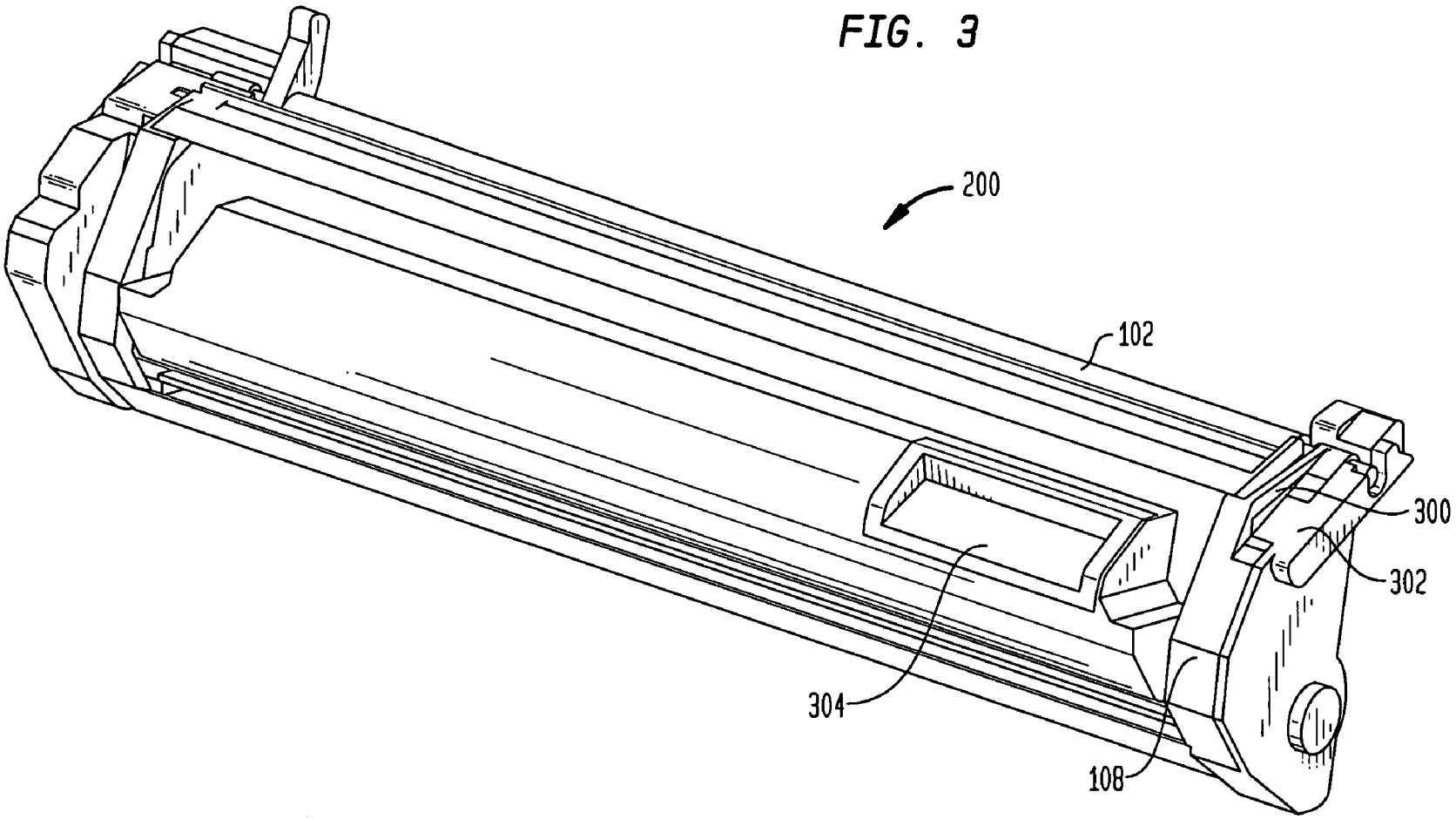
FIG. 3 shows a perspective view of a modified toner waste bin assembly in accordance with the present invention.
Figure 4:
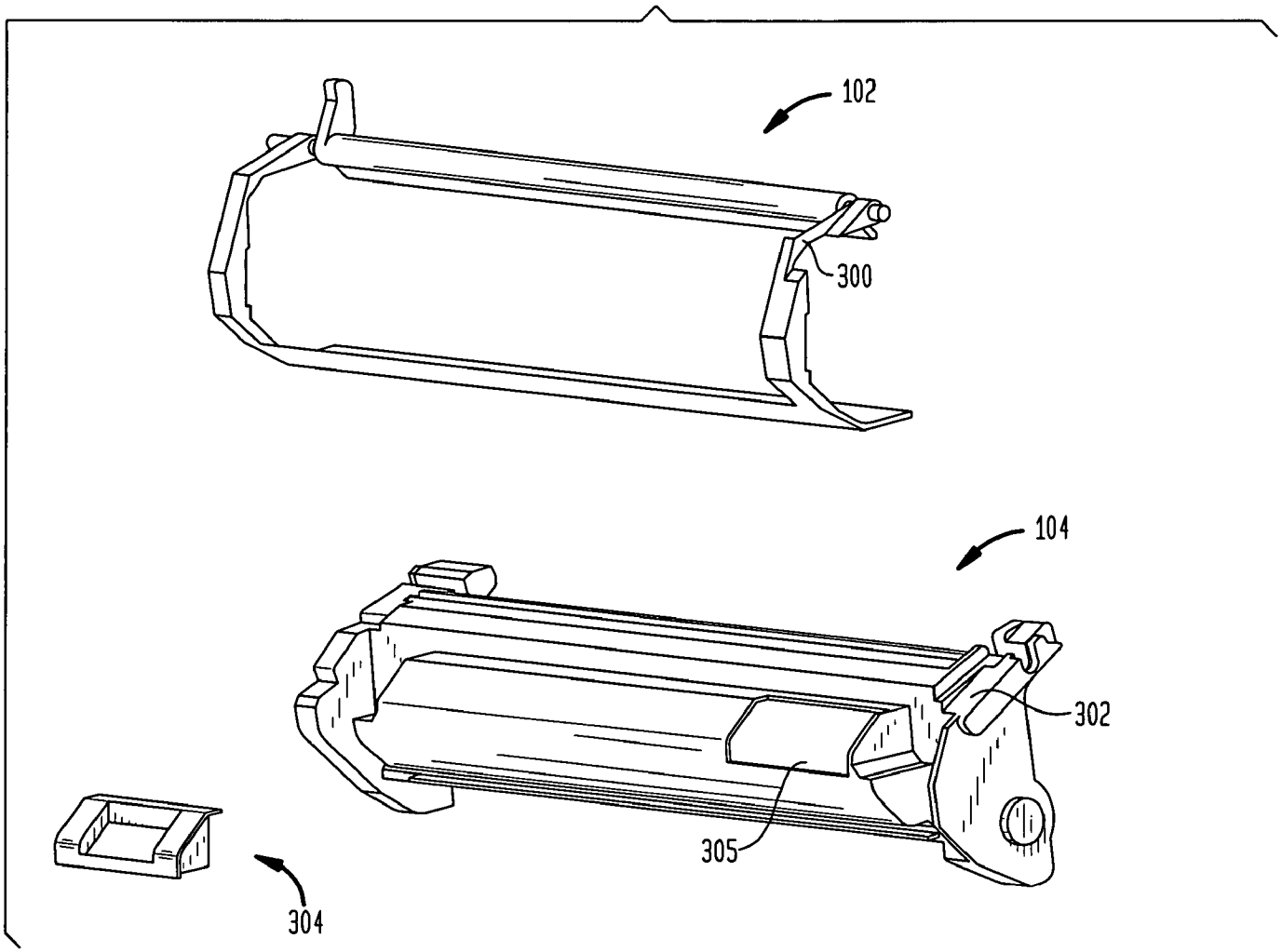
FIG. 4 shows an exploded perspective view of a modified toner waste bin assembly in accordance with the present invention.
Figure 5:
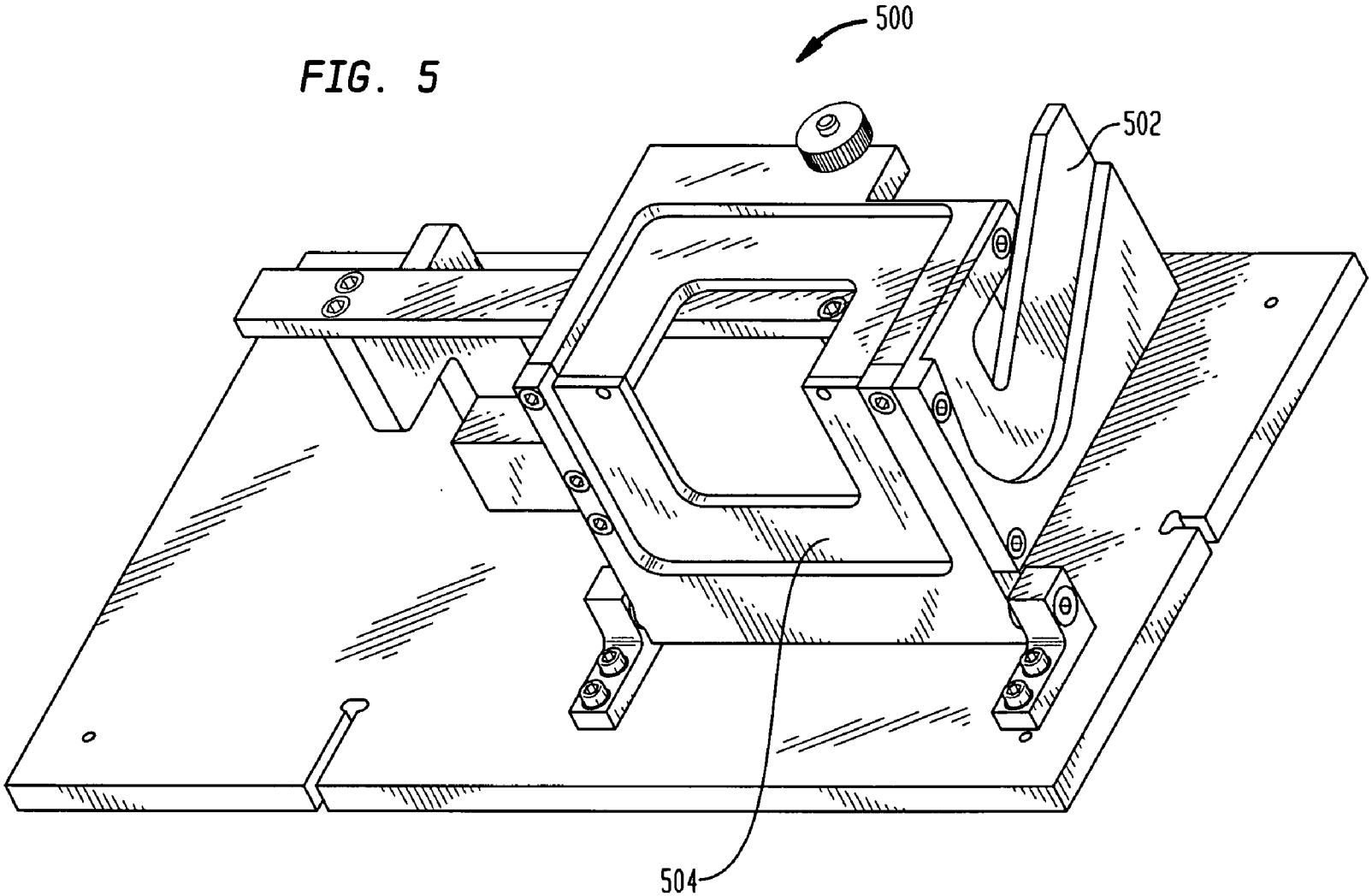
FIG. 5 shows a conversion jig in accordance with the present invention.

FIGS. 3 and 4 show a perspective view and an exploded perspective view, respectively, of a modified waste bin assembly 200 including the drum shutter 102 (described above) in accordance with the present invention. As described in greater detail below, the waste bin assembly 200 may be part of an HP1200 toner cartridge which has been modified in order to allow the HP1200 toner cartridge to operate in an HP1300 printer. In one aspect of the present invention, a modification to the waste bin assembly 100 involves removing a portion of the shutter arm 108 adjacent to area 300 and a portion of the waste bin 104 adjacent to area 302. Leaving these portions attached to the waste bin assembly 200 would interfere with the seating position of the toner cartridge in an HP1300 printer. This removal of these portions may be accomplished by using a RotoZip® cutter or the like. As shown in FIG. 5, a conversion jig 500 may be used to correctly position and guide the RotoZip® cutter along guide path 502 to perform this cut. In a preferred embodiment, electrical tape may be applied to the shutter arm 108 in the area of the cut to prevent the shutter arm 108 from being welded to the waste bin 104 during the cutting process. Additionally, electrical tape may be used to secure the shutter arm 108 in position against the waste bin 104.

HP1300 toner cartridges include electronic chips having memory elements that communicate with the HP1300 printer to report toner levels and provide other functionality. These electronic chips are not utilized by HP1200 printers, and thus are not included with the waste bin assembly 100 of the prior art toner cartridge. In accordance with one aspect of the present invention, as shown in FIGS. 3 and 4, a portion 305 of the waste bin assembly 200 may be removed and a chip mounting patch 304 for holding an electronic chip is attached to the waste bin assembly 200. The electronic chip may be an HP1300 compatible chip, such as the HP1300 smartek™ chip available from Static Control Components, Inc. The removal of the portion 305 of the waste bin assembly 200 may be accomplished by using a RotoZip® cutter or the like. As shown in FIG. 5, the conversion jig 500 may be used to correctly position and guide the RotoZip® cutter along guide path 504 to perform this cut. The chip mounting patch 304 may be mounted on the waste bin assembly 200 using adhesive or other suitable techniques.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of modifying a toner cartridge intended for operation in a first type of imaging device to operate in a second type of imaging device, the method comprising:

providing the toner cartridge adapted for operation in the first type of imaging device, said toner cartridge comprising a drum shutter connected to a waste bin, said drum shutter comprising first and second shutter arms; and removing a portion of the first shutter arm in order to allow the toner cartridge to be inserted into the second type of imaging device.

2. The method of claim 1 further comprising:

removing a portion of the waste bin adjacent to the first shutter arm.

3. The method of claim 2 wherein the steps of removing are performed substantially simultaneously.

4. The method of claim 2 further comprising:

removing a second portion of the waste bin to form a hole in the waste bin;

attaching a chip mounting patch to the waste bin to fill the hole; and attaching a computer chip to the chip mounting patch.

5. The method of claim 4 wherein the computer chip is adapted for operation with the second type of imaging device.

6. The method of claim 2 wherein the portions removed from the first shutter arm and waste bin are selected to allow the toner cartridge to be inserted into the second type of imaging device.

7. The method of claim 2 further comprising, before the steps of removing:

securing the drum shutter and the waste bin in a conversion jig comprising a guide path.

8. The method of claim 7 wherein the steps of removing further comprise:

cutting the first shutter arm and the waste bin along a path defined by the guide path of the conversion jig.

9. The method of claim 1 further comprising, after the step of removing:

operating the toner cartridge in the second type of imaging device.

* * * * *